US005299343A

United States Patent [19]

Tomoto et al.

[11] Patent Number: 5,299,343

[45] Date of Patent: Apr. 5, 1994

[54] CREEL DEVICE FOR A MACHINE FOR HANDLING SLIVERS

[75] Inventors: Yoshiharu Tomoto, Gifu; Hiroshi Nagaosa, Inazawa, both of Japan

[73] Assignee: Howa Machinery, Ltd., Aichi, Japan

[21] Appl. No.: 973,411

[22] Filed: Nov. 9, 1992

[30] Foreign Application Priority Data

Nov. 12, 1991 [JP] Japan ..... 3-325158

[51] Int. Cl.[5] ..... D04H 11/00

[52] U.S. Cl. ..... 19/157; 19/236

[58] Field of Search ..... 19/66 T, 236, 288, 65 A, 19/65 T, 150, 157, 144, 145, 145.5; 226/108

[56] References Cited

U.S. PATENT DOCUMENTS

| | | | |
|---|---|---|---|
| 3,337,923 | 8/1967 | Whitehurst | 19/157 |
| 3,562,867 | 2/1971 | Kaiser | 19/150 |
| 4,195,388 | 4/1980 | Bulla | 19/157 |
| 4,996,748 | 3/1991 | Jornot . | |
| 5,023,976 | 6/1991 | Meyer et al. | 19/144 |

FOREIGN PATENT DOCUMENTS

| | | | |
|---|---|---|---|
| 0367042 | 5/1990 | European Pat. Off. . | |
| 0367211 | 5/1990 | European Pat. Off. . | |
| 0425803 | 5/1991 | European Pat. Off. . | |
| 2230644 | 12/1972 | Fed. Rep. of Germany | 19/157 |
| 9107279 | 8/1991 | Fed. Rep. of Germany . | |
| 2143229 | 2/1973 | France . | |
| 4723301 | 7/1972 | Japan . | |
| 62-49369 | 10/1987 | Japan . | |
| 63-48611 | 12/1988 | Japan . | |
| 836270 | 6/1960 | United Kingdom | 19/157 |
| 1540491 | 2/1979 | United Kingdom . | |

*Primary Examiner*—Clifford D. Crowder
*Assistant Examiner*—Michael A. Neas
*Attorney, Agent, or Firm*—Stevens, Davis, Miller & Mosher

[57] ABSTRACT

A creel device for a drawing frame, having a drive train for lifting rollers for taking out slivers from respective cans. In one embodiment, the cans are divided into two groups each constructed at consecutively located cans. The drive train is divided into two sections for driving respective lifting rollers for respective groups of cans. The basic section is for driving lifting rollers for the group adjacent the draft part, and the second section is for driving lifting rollers from the group remote from the drafting part. The first section is connected to a rotating movement source in the machine frame, while the second section is connected to a variable speed motor. The speed of the variable motor is set so that a predetermined ratio is obtained between the rotational speed of the lifting rollers of the second group and the rotational speed of the lifting rollers of the first group, so that a substantially equal tension is obtained between the sliver taken out from the can adjacent the draft part in the first group and the sliver taken out from the can adjacent the draft part in the second group.

8 Claims, 6 Drawing Sheets

Fig. 6—A
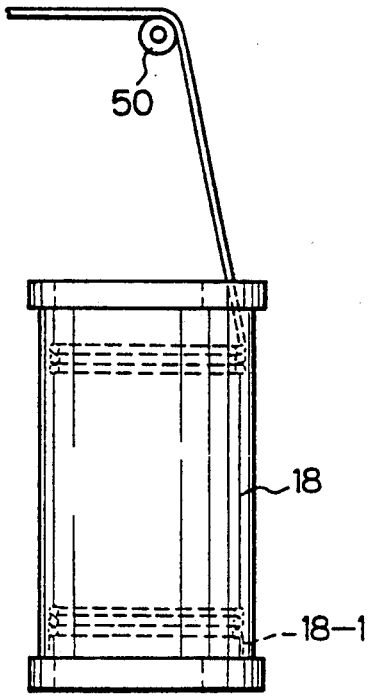
Fig. 6—B
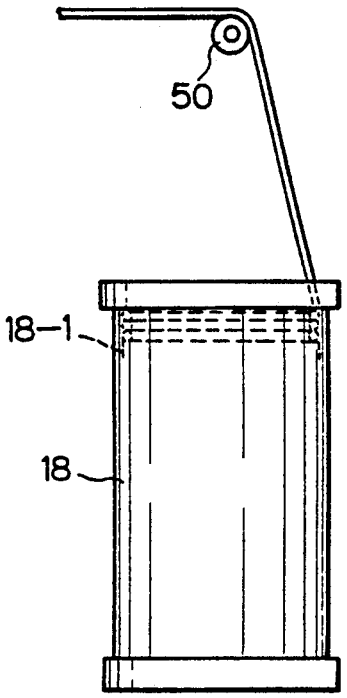
Fig. 7—A
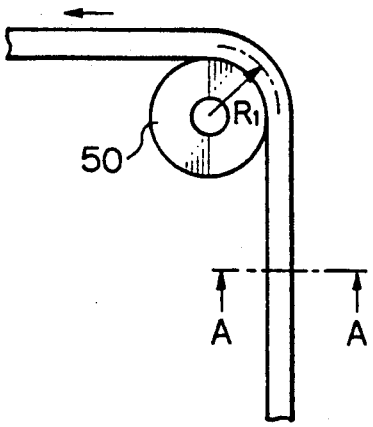
Fig. 7—B
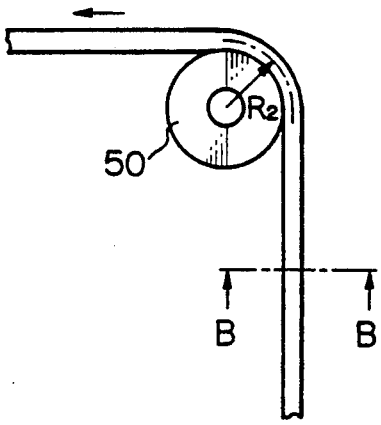
Fig. 8—A
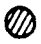
Fig. 8—B
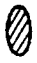

CREEL DEVICE FOR A MACHINE FOR HANDLING SLIVERS

BACKGROUND OF THE INVENTION

1. Field of the Invention

The present invention relates to a device for driving lifting rollers in a creel stand in a spinning machine for treatment of slivers from a plurality of cans, such as a drawing frame and a roving frame.

2. Description of Related Art

It is well known that a drawing frame is for doubling a plurality of slivers from respective cans supplied to a corresponding drafting part to produce a more even sliver at the drafting part. The drawing frame is provided with a creel provided with a plurality of lifting rollers for taking out respective slivers from respective cans. The sliver cans for supplying the corresponding draft part are arranged along a single line. Namely, a plurality of the lifting rollers are arranged on the creel at positions spaced along this line. The slivers from the cans are taken out therefrom by the rotation of the respective lifting rollers toward the drafting part.

In the prior art, a single electric motor for driving the lifting rollers is provided. In this case, a difference in the tension of slivers taken out from the respective cans is, even if it is very small, created between the cans due to the change in the length of the sliver and weight. Namely, so long as the peripheral speed of the lifting rollers are the same for all of the cans, the farther a can is located away from the drafting part, the larger the tension of the sliver from the corresponding can. As a result, the longer the distance from the main part the higher the tension of the slivers taken out from the respective cans. The larger the tension of the slivers, the larger the elongation of the slivers. In other words, the farther a can is located away from the draft part the larger the amount of sliver remaining in a can will be wasted when the sliver from the nearest can is exhausted. As a result of a continuous increase in the remaining amount of sliver from the second cans to the last cans, the total amount of sliver remaining in the can is highly increased.

In order to obviate this difficulty, it can be conceived that a gearing of the train for driving the lifting rollers is such that the larger the rotational speed of the lifting rollers, the farther the cans are located away from the main part in such a manner that the tension of the slivers is equalized irrespective of the positions of the cans. In order to obtain an equalized tension, it may also be conceived to change the outer diameter between the lifting rollers in such a manner that the larger the outer diameter of the lifting rollers, the father the cans are located away from the main part. Furthermore, the Japanese Un-Examined Utility Model Publication No. 47-23301 discloses lifting rollers having tapered portions for holding slivers, and the contact positions of the slivers with the respective tapered portions are changed in such a manner that the slivers contact with the tapered portions at larger diameter points as the cans are located farther away from the drafting parts.

As is well known, the tension of the slivers during the drawing process should be controlled to a desired setting in accordance with process conditions, such as the characteristic of the fibers constructing the slivers, the weight of the slivers, and the speed of the drawing process. Namely, upon any change in the drawing conditions, it is essential to control the tension of the slivers to a desired value by varying the speed of the slivers introduced into the drafting parts. Upon such adjustment of the sliver tension, in order to maintain a constant tension of the slivers, the above prior art require change in gear members in the driving chain or a change in the position of the contact of the slivers with respective taper portions of the lifting rollers, which is tedious and complicated, and can only provide a very limited range of adjustment in the tension. Furthermore, a large number of extra parts, such as sets of gear wheels for changing the speed of the lifting rollers, are required.

SUMMARY OF THE INVENTION

An object of the present invention is to provide a spinning machine for the treatment of slivers capable of reducing the total amount of remaining sliver in cans when the old cans are changed to new cans, while the constitution is simple and involves low cost.

According to the present invention, a machine is provided for the treatment of slivers from a plurality of cans for storing respective slivers, comprising:

a main part comprising a set of rollers through which slivers are drafted, and a source for generating the rotational movement of said rollers;

a creel device including a frame structure and lifting rollers supported thereby and arranged so as to be spaced substantially along a straight line that extends rearwardly from the main part, for taking out slivers to be supplied to the main part from respective cans that are also arranged substantially along said line;

said cans on said line being divided into at least two groups, each constructed by consecutively located cans along the line;

separate drive trains provided for the respective groups of the cans for obtaining the independent rotational movement of the lifting rollers between said groups;

rotational movement sources connected to the drive trains separately for obtaining the independent rotational movement of the respective drive trains;

at least the rotational movement sources for the drive train for the lifting rollers of the group other than the group including the can nearest said main part being constructed as a variable speed control type capable of obtaining a varied rotational speed of the corresponding lifting rollers, and;

means for controlling the rotational movement source for the variable speed control type drive train to obtain a predetermined ratio of a value of the rotational speed of the lifting rollers driven by the variable speed control type drive train to the rotational speed of the lifting roller driven by the drive train for the group of the cans located adjacent the main part, whereby the slivers from the cans nearest the main part in the respective groups of the cans are exhausted substantially simultaneously irrespective of the operating condition of the machine.

According to the present invention, the cans are divided into a plurality of groups, and separate drive trains are provided for the lifting rollers of the respective groups. Furthermore, the train remote from the main part is constructed as a variable speed type, and the rotational speed of the variable speed train is present so that a desired ratio is obtained between the lifting rollers in the train near the main part and the lifting rollers in the variable speed train. As a result, the slivers from the cans nearest the main part in the respective groups of cans are exhausted substantially simultaneously irrespective of the operating condition of the machine, due to equalized tension of the slivers. As a result, the total amount of slivers remaining in the cans when the single drawing process is ended can be reduced.

BRIEF DESCRIPTION OF THE ATTACHED DRAWING

FIG. 6-(A) illustrates a condition of a sliver in a can when full.

FIG. 6(B) illustrates a condition of a sliver in a can when nearly empty.

FIG. 7-(A) illustrates a condition of a sliver when it passes around a lifting roller when the can is full.

FIG. 7-(B) illustrates a condition of a sliver when it passes around a lifting roller when the can is nearly empty.

FIG. 8-(A) shows a cross-sectional view of a sliver along A—A line in FIG. 7-(A) when the can is full.

FIG. 8-(B) shows a cross-sectional view of a sliver along B—B line in FIG. 7-(B) when the can is nearly empty.

DESCRIPTION OF PREFERRED EMBODIMENTS

Figure 1:
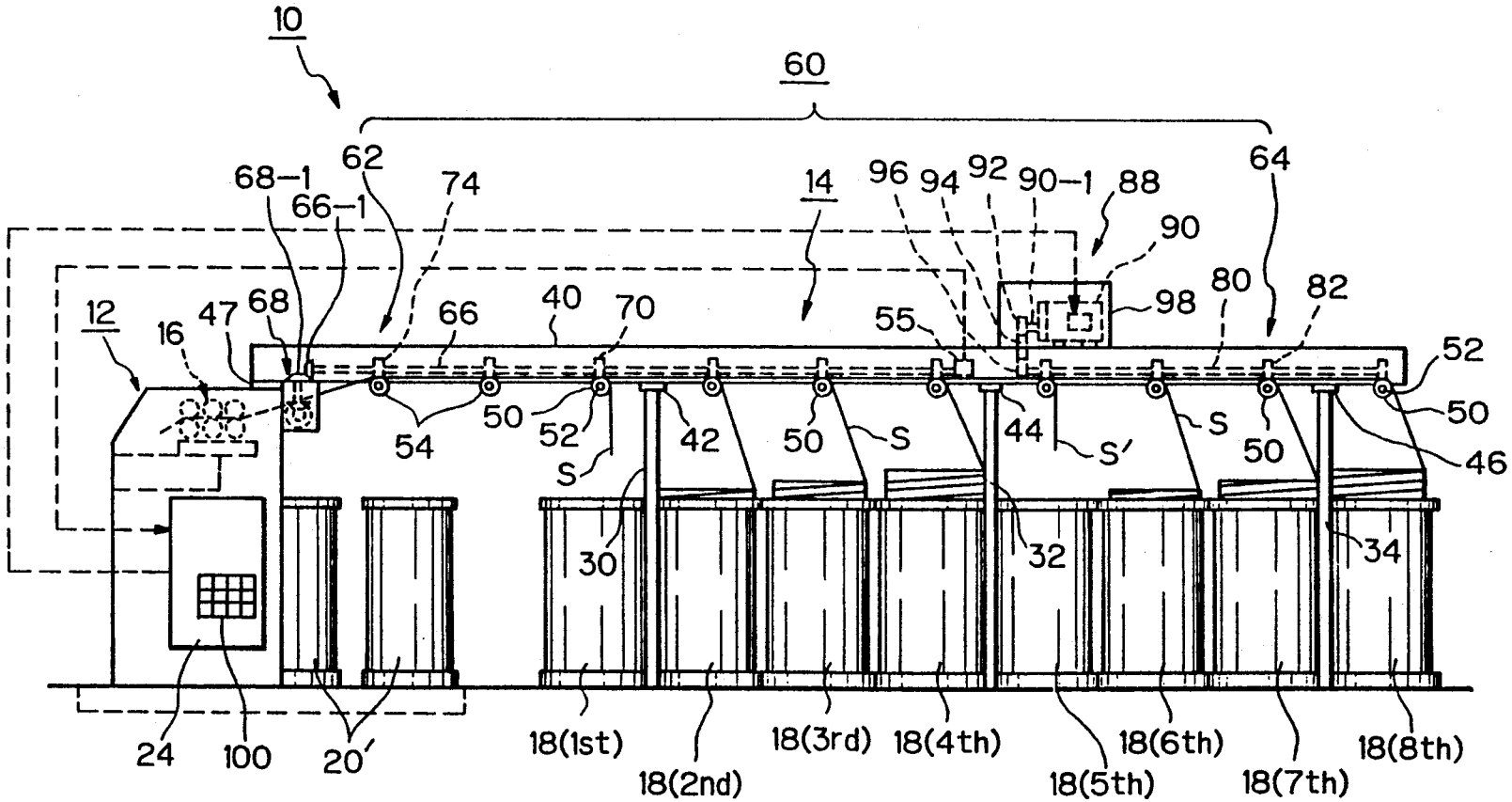
FIG. 1 is a lateral side view of a drawing frame according to the present invention.
Figure 2:
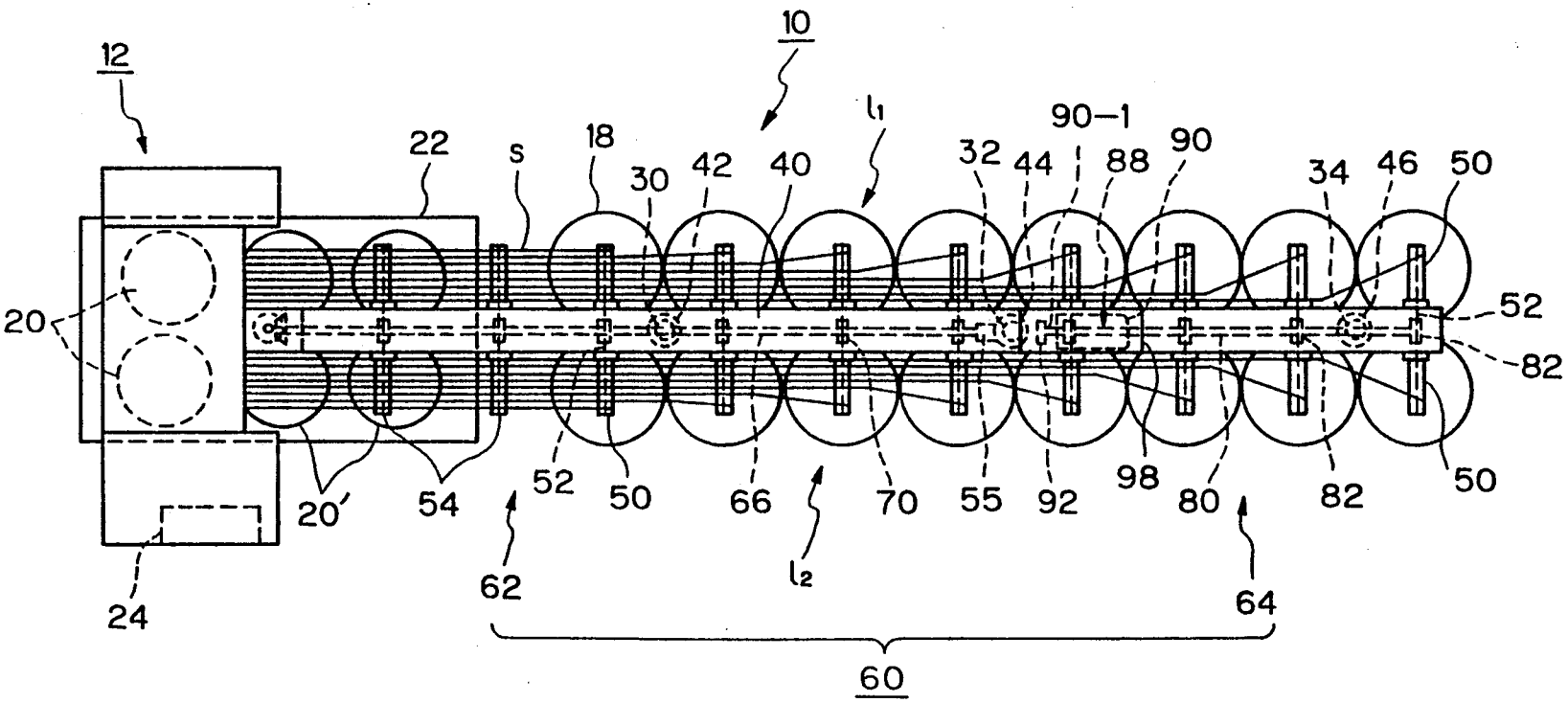
FIG. 2 is a top plane view of the drawing frame according to the present invention shown in FIG. 1.

Now, embodiments of the present invention will be explained with reference to the attached drawings. In FIGS. 1 and 2, a drawing frame 10 is essentially constructed by a main part 12 and a creel part 14. The main part 12 basically includes draft parts 16, each of which includes spaced pairs (three pairs) of bottom and top rollers, between which slivers S from cans 18 are passed so that they are subjected to a drafting process. As seen from FIG. 2, these cans 18 are arranged to form two straight rows $1_1$ and $1_2$ that extend rearwardly from the main part 12 of the drawing frame. In other words, the drawing frame 10 in this embodiment is a so called two head type having two laterally spaced two drafting parts each supplied by the rows $1_1$ and $1_2$, respectively. After being subjected to the drawing process, the slivers from the respective drafting parts 16 are stored into respective cans 20 as shown in FIG. 2. Arranged between the main part 12 and the rows $1_1$ and $1_2$ of cans 18 is a device 22 for supplying empty cans 20' to be replaced for the cans 20 after the latter are filled by the slivers as drafted. A reference numeral 24 generally designates a control unit for issuing signals for obtaining various control operations of the drawing frame.

The creel part 14 includes three vertically extending pillars 30, 32 and 34 that are spaced along the rows of the cans so that these pillars 30, 32 and 34 are located between the rows $1_1$ and $1_2$ of the cans. These pillars 30, 32 and 34 are fixedly connected at their bottom ends to the floor of the factory. A creel beam 40 has, at its lower side, brackets 42, 44 and 46 fixedly connected to the top end of the pillars. The beam 40 is connected at its front end to the main part 12 via a creel bracket 47. Arranged below the bottom surface of the beam 40 are a plurality of shafts 52 that are spaced parallel along the length of the rows of the cans, and each of the shafts extends transverse to the direction of the cans rows $1_1$ and $1_2$. These shafts 52 are rotatable by means of respective bearings (not shown) for rotatably supporting the shaft to the beam 40. Each of the shafts 52 has a pair of axially spaced ends to which lifting rollers 50 are fixedly connected so that the rollers 50 extend transversely in a cantilever fashion at locations above respective cans in the respective rows $1_1$ and $1_2$. As will be easily understood, these lifting rollers 50 are for taking out slivers from the respective cans and for guiding the slivers from cans located upstream therefrom in the respective rows $1_1$ and $1_2$. In addition to the lifting rollers 50 corresponding to the respective cans 18, guiding rollers 54 are arranged on the beam 40 in the same manner as that of the lifting rollers 50. These guiding rollers 54 are for guiding the slivers from the lifting rollers 50 of the respective cans to the respective drafting parts 16.

Now, a driving train 60 for obtaining a rotational movement of the lifting rollers 50 will be explained. The driving train 60 is, according to this embodiment, constructed by a basic driving train 62 for driving a first group of the lifting rollers 50 from the first to fourth cans 18 located adjacent the main part 12, and a variable speed driving train 64 for driving a second group of the lifting rollers 50 from the remaining fifth to eighth cans 18 spaced from the main part 12. The basic driving part 62 includes a basic drive shaft 66 extending along the length of the beam 40 and rotatably supported to the beam by well known bearings (not shown). The basic train 62 further includes a transmission device 68 for imparting the rotational movement taken out from a rotating movement source (not shown) from the main part 12 into the basic shaft 66 of the basic gear train 62. Namely, the transmission 68 includes an output bevel gear 68-1, while the basic shaft 66 includes an input bevel gear 66-1 that engages with the output bevel gear 68-1 of the transmission 68 so that the rotational movement from the main part 12 is transmitted to the basic shaft 66. Furthermore, the basic train 62 is also provided with helical gears 70 fixedly mounted on the basic drive shaft 66, while the shaft 52 of the respective pairs of the lifting rollers 50 include helical gears (not shown) with which the helical gears 70 on the basic drive shaft 66 engage. As a result, the rotational movement applied to the basic drive shaft 66 from the transmission 68 is applied to the lifting rollers 50 from the respective cans for the slivers. It should also be noted that helical gears 74 are also provided on the basic drive shaft 66 so that the gears 74 engage respective helical gears on the shafts for the guiding rollers 54 for imparting a rotational movement to the guiding rollers 54. At the rear end of this basic drive train 62, a detector 55 is connected to the end of the basic shaft 66 for detection of the rotational speed of the shaft 66 to provide a signal indicating thereof, which is introduced into the control circuit 24.

The variable speed drive train 64 is basically constructed by a variable speed shaft 80 on which helical gears 82 are fixed, which engages corresponding helical gears fixed on the shaft 52 of the lifting rollers 50 for the fifth to eighth cans that are located remote from the main part 12 with respect to the first to fourth cans. The variable speed shaft 80 is, on its front end, provided with a pulley 96. A reference numeral 88 is a step-less speed variation device for driving the lifting rollers 50 for the slivers from the fifth to eighth cans. The step-less speed variable device 88 includes a variable speed electric motor 90 constructed by, for example, a servomotor or an inverter controlled motor mounted on the top of the beam 40 of the creel 14. The variable speed motor 90 has a rotating shaft 90-1 having an end on which a drive pulley 92 is mounted. This pulley 92 is connected, via a belt 94, to a pulley 96 mounted on an end of the drive variable speed shaft 80 of the second gear train 64. The device 88 is further provided with a removable cover 98 in which the variable speed motor 90 is housed.

The control circuit 24 provided in the main part 12 is provided with a pre-setter 100 for controlling the ratio of the rotational speed of the four lifting rollers 50 operated by the variable speed drive train 64 to the rotational speed of the four lifting rollers 50 operated by the basic drive train 62. The control circuit 24 is further provided with a rotational speed controller (not shown) for controlling the variable speed motor 90 so that the rotational speed of the rotational speed of the four rollers 50 connected to the variable speed drive train 74 is equal to the predetermined value set by the pre-setter 100.

The device for controlling the speed of the lifting rollers 50 in the creel 14 of the drawing frame operates as follows. Before the drawing process is commenced, a value of the ratio of the rotational speed of the lifting rollers 50 driven by the variable drive train 64 to the rotational speed of the lifting rollers 50 driven by the basic drive train 62 is introduced into the pre-setter 100; the value of which is selected for obtaining a substantially equal tension between the sliver that is taken out from the first can 18 by the lifting roller 50 adjacent the main part 12 in the rollers driven by the variable drive train 64 and the sliver that is taken out from fifth can by the lifting roller 50 adjacent the main part 12 in the rollers driven by the basic drive train 62. Such a value of the ratio is obtained based on experience or tests. A drawing operation is, then, commenced so that the slivers from the first to eighth cans are taken out by the respective lifting rollers 50 and are supplied to the respective drafting units 16 to obtain respective slivers as drawn, which are introduced into the respective cans 20. In this case, the transmission device 68 transmits the rotational movement taken out from the main part 12 into the drive shaft 66 of the basic drive train 62, which causes the lifting rollers 50 in the basic drive train 62 to be rotated for taking out the respective slivers from the respective 1st to 4th cans 18. The sensor 55 detects the rotational speed of the shaft 66 and a signal indicating the same is introduced into the control circuit 24. Simultaneously, the variable speed motor 90 rotates the drive shaft 80 in the variable speed train 64, which causes the lifting rollers 50 in the variable speed train 64 to be rotated for taking out the respective slivers from the respective 5th to 8th cans 18. The control circuit 24 issues a signal to the variable speed motor 90 for obtaining the preset ratio of the rotational speed of the drive shaft 80 in the variable speed train 64 to the rotational speed of the drive shaft 66 in the basic drive train 62 sensed by the sensor 55. As a result, a substantially equal tension is obtained between the sliver that is taken out from the 5th can 18 by the lifting roller 50 adjacent the main part 12 in the rollers driven by the variable drive train 64, and the sliver that is taken out from 1st can 18 by the lifting roller 50 adjacent the main part 12 in the lifting rollers driven by the basic drive train 62, which allows the first can 18 driven by the first train 62 and the fifth can 18 driven by the second train 64 to be emptied substantially at the same time, as illustrated by the ends S' of the slivers depending on the respective lifting rollers 50 adjacent the main part 12 in the respective groups of the cans. In the respective drive trains, it is still true that the farther the cans are from the main part 12, the larger the amount of slivers remaining in the cans 18, when a single drawing process is finished due to the fact that the larger the tension of the sliver the more the can is spaced from the main part. However, the provision of a variable speed drive train 64 for driving the lifting rollers 50 for the group of cans located away from the main part 12 according to the present invention makes it possible to reduce the total amount of slivers remaining in the cans 18.

Figure 3:
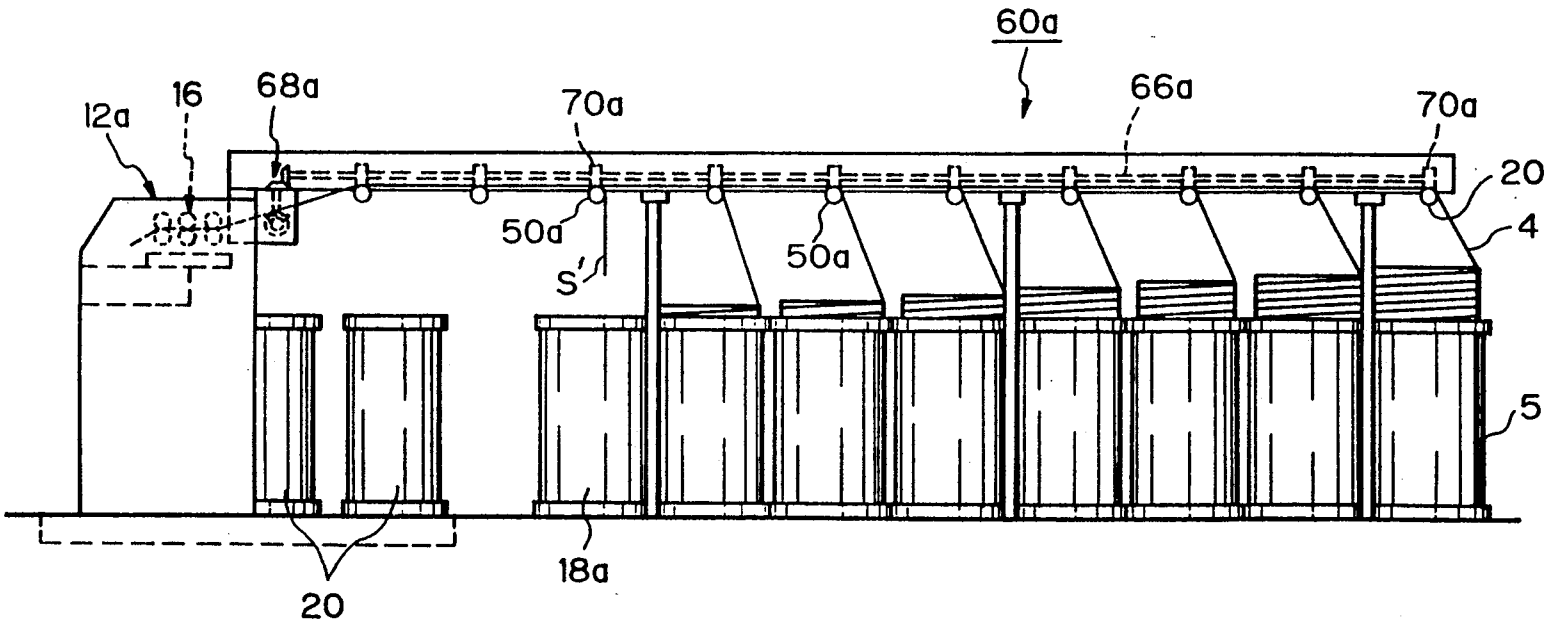
Fig. 3 (PRIOR ART)
FIG. 3 is similar to FIG. 1, but shows a drawing frame in the prior art.

FIG. 3 is similar to FIG. 1 but schematically illustrates the construction in a conventional lifting roller drive system, where a single drive train **60*a* is provided that has a single drive shaft 66*a* for driving lifting rollers 50*a* for all of the eighth cans 18*a*. Namely, the drive shaft 66*a* is connected, at its one end, to a transmission device 68*a* connected to a rotating movement source in a main part. The drive shaft 66*a* is provided with helical gears 70*a* engaging on respective helical gears (not shown) on respective shafts (not shown) from which the respective lifting rollers 50*a* extend in cantilever fashion, so that the slivers from the 1st to 8th cans are taken out therefrom toward respective draft parts 16*a* by the rotational movement of the respective lifting rollers 50 driven by the common single shaft 66*a* connected to the transmission unit 68*a*. In this case, if the peripheral speed of the lifting rollers are the same, at the moment when the rear end S' of the sliver from the 1st can 18 adjacent the main part 12** is just taken out to stop the frame, the slivers still remain in the respective 2nd to 8th cans. The amounts in remaining cans are continually increased from the 2nd cans to the 8th cans, so that the total amount of residual slivers is increased, significantly, which is subjected to recovering process, thereby causing increased production costs, since extra labor is required.

As will be clear, the division of the driving train into the basic sections 62 operated by the transmission 68 from the main part 12 and the variable speed section 64 operated by the variable driving motor 90 in FIGS. 1 and 2 can, according to the present invention, decrease the total amount of residual slivers.

The present invention is advantageous in that a setting is easy upon a change in drawing conditions. Namely, a mere input of the desired value of the rotational speed ratio into the setter 100 is sufficient to do so.

Figure 4:
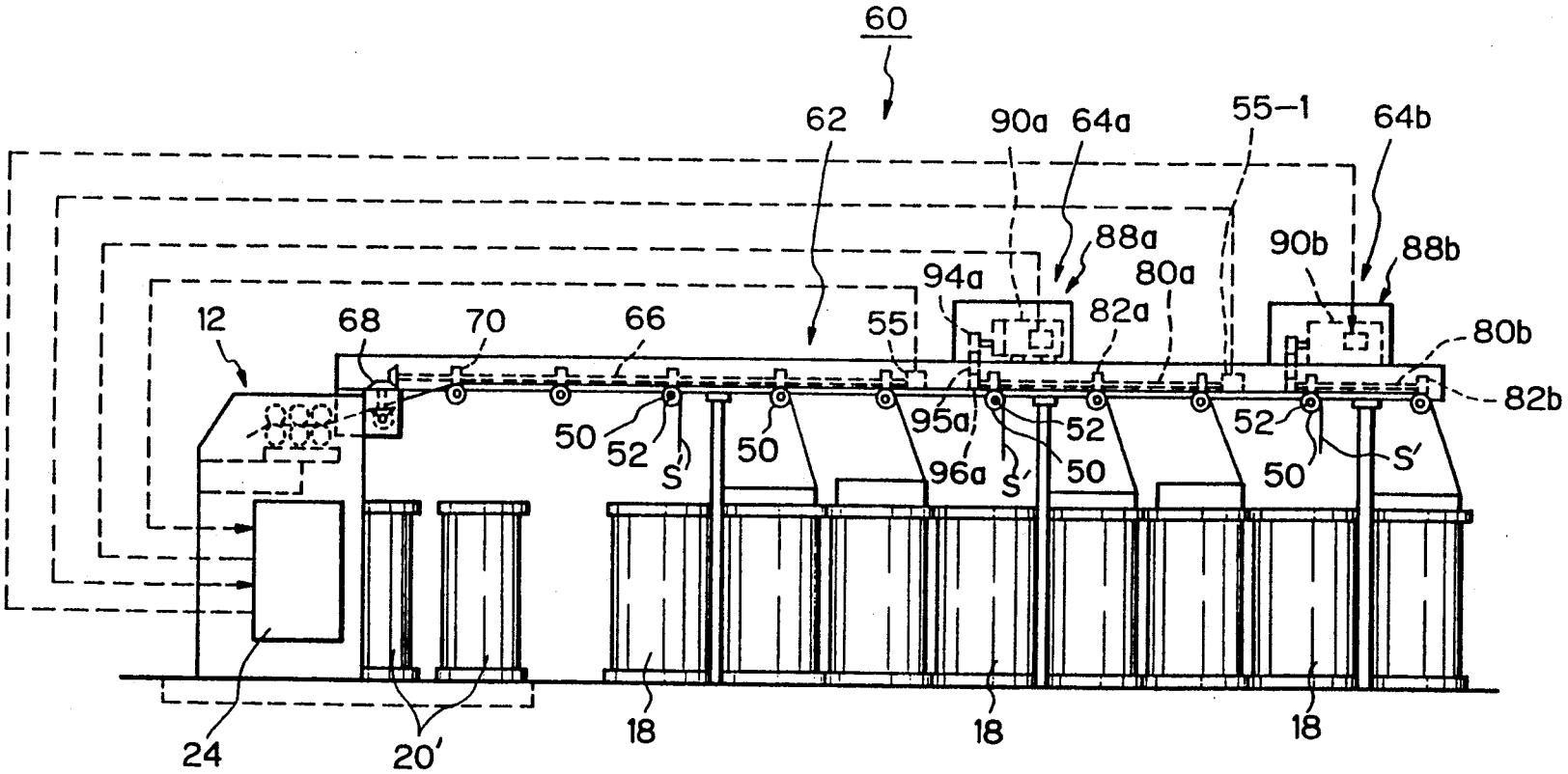
FIG. 4 shows a lateral side view of the drawing frame according to a second embodiment of the present invention.

FIG. 4 shows a second embodiment of the present invention. In this embodiment, the drive train is divided into 3 groups, including a basic train and two variable trains, although it is possible to divide the train into more than three groups. Namely, a drive train 60 is provided with a basic train 62 for driving the lifting rollers 50 from the 1st to 3rd cans 18, a first variable speed train **64*a* for driving the lifting rollers 50 from the 4th to 6th cans 18 and a second variable speed train 64*b* for driving the lifting rollers 50 from the 7th and 8th cans. The basic train 60 includes a drive shaft 66 on which helical gears 70 are provided that engage corresponding helical gears on respective shafts 52 from which opposite pairs of respective lifting rollers 50 for the slivers from the 1st to 3rd cans 18 extend as already explained with reference to the first embodiment. The drive shaft 66 is connected to the rotating movement source in a main part 12 via a transmission unit 68 so that a rotating movement is applied to the lifting rollers 50 for taking out the slivers from the 1st to 3rd cans. The first variable speed train 64a has a drive shaft 80a on which helical gears 82a are provided for engaging helical gears of shafts from which respective opposite pairs of lifting rollers 50 extend for taking out slivers from respective 4th to 6th cans 18. A first variable speed device 88a includes a variable speed motor 90a that has an output shaft having a pulley 94a connected to, by a belt 95a, a pulley 96a on the end of the shaft 80a, so that a variable speed rotational speed rotational movement from the motor 90a is applied to the shaft 80a for rotating the lifting rollers 50 for taking out the slivers from the 4th to 6th cans 18. The construction of the second variable speed train 64b is similar to that of the first variable speed train 64a. Namely, the second variable speed train 64b has a drive shaft 80b on which helical gears 82b are provided for engaging helical gears of shafts 52 from which respective opposite pairs of lifting rollers 50 extend for taking out slivers from respective 7th and 8th cans 18. A variable speed device 88b includes a variable speed motor 90b that has an output shaft connected to the shaft 80b via the similar pulleybelt mechanism, so that a variable speed rotational speed rotational movement from the motor 90b is applied to the shaft 80b for rotating the lifting rollers 50 for taking out the slivers from the 7th and cans 18**.

A sensor 55 is provided for detection of the rotational speed of the shaft 66 of the basic drive train 62. Furthermore, a sensor 55-1 is provided for detection of the rotational speed of the shaft 80a of the first variable speed drive train. These signals from the sensors 55 and 55-1 are input to the control circuit 24. Similar to the first embodiment, based on the detected rotational speed of the shaft 66, the control circuit 24 issues a signal directed to the variable speed device 64a for controlling the rotational speed of the drive shaft 88a of the first variable train so that a present ratio of the rotational speed of the variable speed shaft 88a is obtained with respect to the rotational speed of the basic shaft 66. Furthermore, based on the detected rotational speed of the shaft 88a, the control circuit 24 issues a signal directed to the second speed device 64b for controlling the rotational speed of the drive shaft 88b of the second variable train so that a preset ratio of the rotational speed of the variable speed shaft 88b is obtained with respect to the rotational speed of the first variable speed shaft 88a. As a result, tension of the slivers taken out from nearest cans between three groups, i.e., 1st, 4th and 7th cans are equalized. As a result, slivers from first, fourth and seventh cans are exhausted at the same time. FIG. 4 show that the ends S' of the slivers from 1st, 4th and 7th cans 18 are taken out at the same time therefrom. As a result, the total amount of residual slivers on the remaining cans, that is 2nd and 3rd cans, 5th and 6th cans, and 8th cans can be further reduced. As will be understood, an increase in the number of divisions of the train can reduce the amount of residual slivers due to the fact that the residual amount can be zero at the first sliver of each group, and an increase in the residual amount between remaining cans is only done in a step by step manner.

Figure 5:
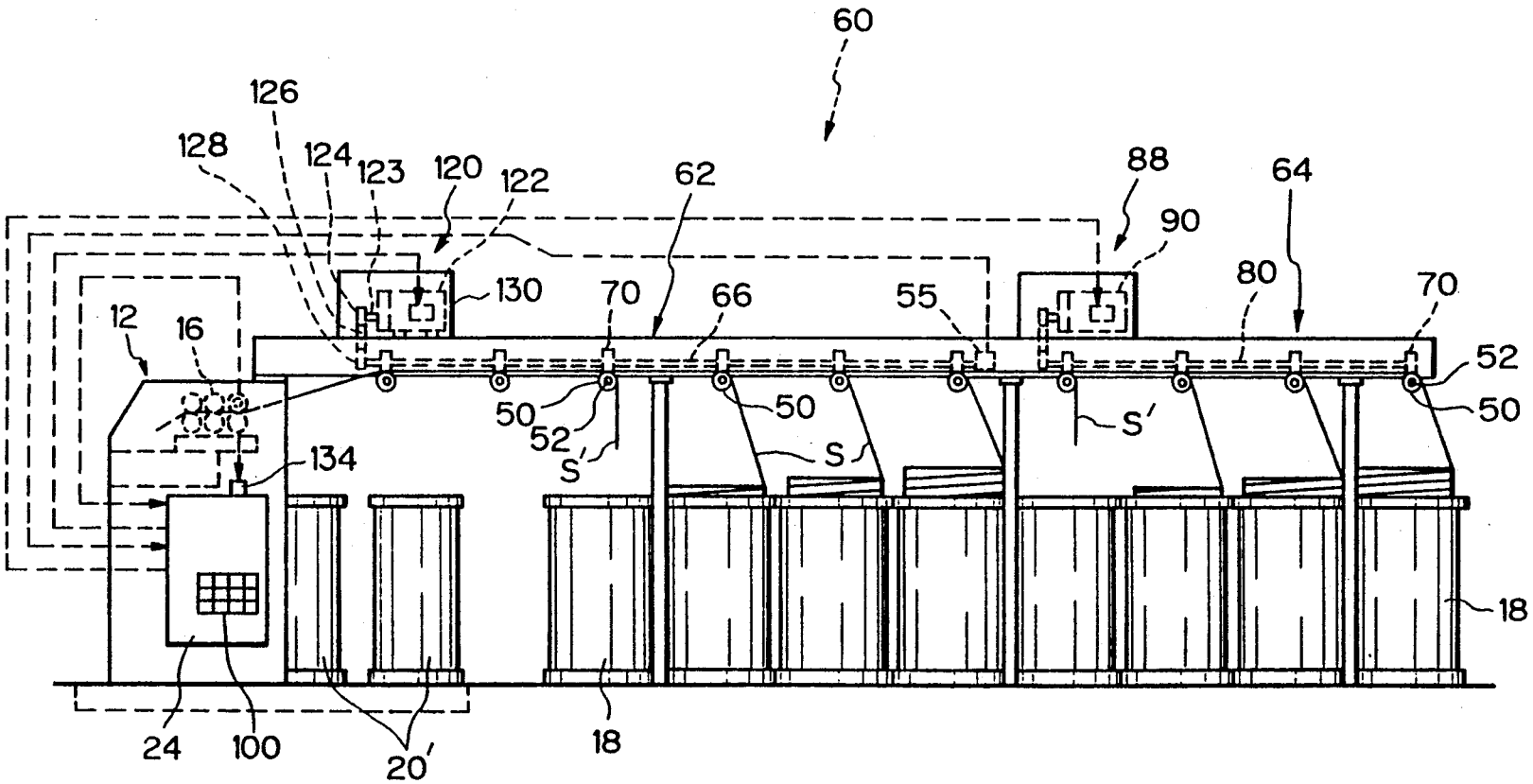
FIG. 5 shows a lateral side view of a drawing frame according to a third embodiment of the present invention.

In FIG. 5 showing a third embodiment, similar to the first embodiment, the drive device 60 is divided into the basic train having a drive shaft 66 for driving lifting rollers 50 for the first to fourth cans 18, and a variable speed train 64 for a drive shaft 80 for rotating the lifting rollers 50 for the slivers from the fifth to eighth cans 18. Similar to the first embodiment, a provision is made for a variable speed device 88 including a variable speed motor for generating a variable speed rotation applied to the drive shaft 80 in the second train 64. The embodiment in FIG. 5 is different from the first embodiment in FIG. 1, in that, in place of a provision of a transmission 68 for connecting the basic drive train 62 with the main part 12, a variable drive device 120 is also provided for generating a rotational movement to the basic drive shaft 66 in the first train. Namely, the variable speed device 120 for the basic train 62 includes a variable speed motor 122 having an output shaft 123 on which a pulley 124 is connected. The pulley 124 is connected, via a belt 126, to a pulley 128 on an end of the drive shaft 66 of the basic train 62. A cover 130 for storing the variable speed motor 122 is provided. A sensor 134 is provided for detecting a rotational speed of the drive system in the main part 12. In this embodiment, the sensor 134 is associated with the draft part 16 for detecting a rotational speed of the rear bottom roller for counting the accumulated number of rotations of the bottom roller that roughly corresponds to the total length of the roving as produced.

It should be noted that in the above embodiments, in place of detection of the rotational speed of the shafts in the basic train and variable speed train, it is possible to detect the rotational speed of the main motor in the main part 12 and the variable speed motor, and the variable speed controller is controlled so that a desired ratio of the rotational speed of the lifting roller of the variable train to the rotational speed of the basic train is obtained.

In the embodiment in FIG. 5, the rotational speed of the basic drive train 62 is also variable, and such variable rotational speed in the basic drive train is done in accordance with the amount of slivers consumed in the case. The sliver in a can 18 is taken out by the corresponding lifting roller 50 from its top side. As is well known, the can 18 is provided with a spring loaded bottom plate 18-1. When the sliver is full, the bottom plate 18-1 is located at its lowest position as shown by FIG. 6-(A), due to a large weight of the sliver in the can. As the slivers in the cans are taken out, the position of bottom plate 18-1 is elevated, as shown in FIG. 6-(B). When the can is full, the cross sectional shape of a sliver at the bottom portion of the can is much more flattened compared to the cross sectional shape of the sliver at the portion of the can, due to the fact that the sliver at the bottom portion is subjected to the weight of the sliver located above this portion, causing the shape of a sliver at the bottom portion when full to be flattened compared to the shape of the sliver at the top portion when full. Namely, when the cans are full as shown in FIG. 6-(A), the sliver taken out by the lifting roller has a rounded shape as shown in FIG. 8-(A) due to the fact that the sliver at the top portion is taken out. Contrary to this, when the can is nearly exhausted, as shown in FIG. 6-(B), the sliver taken out by the lifting roller has a flat shape as shown in FIG. 8-(B) due to the fact that the silver located at the bottom portion when full is now taken out. Due to the change in the cross sectional shape of the silver, a change in the amount of feed per rotation of the sliver is generated. Namely, the amount of delivery of the sliver by the lifting roller 50 is determined by the radius when it moves around the lifting roller 50 as the radius of the lifting roller plus the diameter of the sliver (below, sliver rotating radius). The sliver rotating radius $R_1$ (FIG. 7-A) when the can is full is larger than the sliver rotation radius $R_2$ (FIG. 7-B) when the cans is exhausted. As a result, when compared to the length of the sliver per unit of time when the cans are full, the amount of silvers taken out per unit of time when the cans are exhausted becomes slower. So long as the drawing condition is maintained, a desired setting of the rotational speed of the rotational speed of the shaft can ensure that, upon a preset number of rotation of the back bottom roller in the drafting unit 16 counted by the feed counter 134, an end of the sliver just appears from the first cans 18. However, a change in the drawing condition causes the tension of the sliver taken out from the respective cans 18 to be changed, so that the fixed number of rotations of the drafting unit cannot always correspond to the time when the end S' of the silver just comes out from the first cans 18. Thereby causing the drawing frame to be stopped at a time earlier than the time when it is presumed or an amount of slivers remain in the cans when the drawing frame is stopped.

In order to equalize the amount of silvers taken out from the can 18 irrespective of the amount of slivers remaining in the can 18, according to the embodiment in FIG. 5, a detected value of the feed counter 134 is input into the control circuit 24, and the control circuit issues a signal to the variable speed motor 122 so that the speed of the rotating shaft 124 is changed in accordance with the values of the feed counter, which roughly correspond to the amount of slivers remaining in the cans. Namely, the lesser the amount of silvers remaining in the cans, the higher the speed of the lifting roller 50. Such control of the speed of the lifting roller may be stepwise. For example, each time the residual amount of silvers in the cans reaches 4/5, 3/5, 2/5 and 1/5 with respect to the full amount of the cans, the speed of the variable motor 122 can be correspondingly changed. Namely, when the initial speed of the shaft 50 is N when full, the variable speed motor 122 is controlled so that the speed is increased to $N\times\alpha_1$, $N\times\alpha_2$, $N\times\alpha_3$, $N\times\alpha_4$, at the 4/5, 3/5, 2/5 and 1/5 stages, respectively, where the values of the factor $\alpha_1$, $\alpha_2$, $\alpha_3$, and $\alpha_4$ are larger than 1.0 and are determined so that a desired constant sliver amount is obtained. As a result, it is possible to ensure that a substantially constant amount of slivers are taken out per unit time irrespective of the change in the cross sectional shape of the sliver in accordance with the position of the sliver when can is full.

At the same time as such a change in the drive shaft 66 in the basic train 62, the rotating speed of the drive shaft 80 in the second train is correspondingly controlled to maintain the preset ratio of the rotational speed of the shaft 80 with respect to the shaft 66 in a similar way as explained with reference to the previous embodiments.

So long as the drawing condition is maintained unchanged, the setting of the factor $\alpha_1$, $\alpha_2$, $\alpha_3$, and $\alpha_4$ is maintained. Upon a change in the drawing condition, a new setting of the ratio $\alpha_1$, $\alpha_2$, $\alpha_3$, and $\alpha_4$ is effected to obtain a constant feed amount of slivers from the cans 18 to the respective draft parts irrespective of the change in the drawing condition. Simultaneously, a setting of the second gear train 88 is also effected to obtain a desired ratio of the rotational speed of the lifting roller in the second train 64 with respect to the rotational speed of the lifting rollers in the first train 62 in a similar way as described in the previous embodiments.

It should be noted that, in the embodiment in FIG. 5, the rotational speed of the variable speed devices 120 and 64 can also be controlled based on the rotational speed at the draft portion 16 so that desired rotational speeds are obtained at the lifting rollers of the respective drive train 62 and 64.

It should be noted that the rotational movement source in the main part can be variable so that the rotational speed of the main shaft can vary.

It should be noted that in the embodiment it is explained that the basic train and that variable train are completely separate. However, the variable train can be constructed by a differential gear device and a variable speed motor, or a step-less variable transmission.

While the embodiments of the present invention are described with reference to the attached drawings, many modifications and changes can be made by those skilled in this art without departing from the scope and spirit of the invention.

We claim:

1. A machine for treatment of slivers from a plurality of cans for storing respective slivers, comprising:

a main part comprising a set of rollers through which slivers are drafted, and a main part source for generating rotational movement of said rollers;

a creel device including a frame structure and lifting rollers supported thereby and spaced substantially along a straight line that extends rearwardly from the main part, for taking out slivers from respective cans and directly supplying the slivers to the main part from respective cans that are also arranged substantially along said line;

said cans on said line forming two groups, each of said groups constructed by consecutively located cans along the line;

a separate drive train provided for each of the groups of the cans for obtaining independent rotational movement of lifting rollers of each of said groups;

a first one of said separate drive trains being driven by said main part source;

rotational movement means, connected to a second one of said drive trains separately for obtaining independent rotational movement of said second one of said drive trains, said rotational movement means being constructed as a variable speed control device capable of obtaining a varied rotational speed of lifting rollers of said second group, and;

means for controlling said rotational movement means to obtain a desired tension of slivers taken out from cans by the lifting rollers driven by the second one of said drive trains.

2. A machine for treatment of slivers from a plurality of cans for storing respective slivers, comprising:

a main part comprising a set of rollers through which slivers are drafted, and a main part source for generating rotational movement of said rollers;

a creel device including a frame structure and lifting rollers supported thereby and spaced substantially along a straight line that extends rearwardly from the main part, for taking out slivers to be supplied to the main part from respective cans that are also arranged substantially along said line;

said cans on said line being divided into at least two groups, each of said groups constructed by consecutively located cans along the line;

separate drive trains, provided for each of the groups of cans, for obtaining independent rotational movement of lifting rollers of each of said groups;

rotational movement means, connected to the drive trains separately, for obtaining independent rotational movement of at least one of the drive trains;

at least one of the rotational movement means of the groups, other than the group including the can nearest said main part, being constructed as a variable speed control device capable of obtaining a varied rotational speed of the lifting rollers of a group, and;

means for controlling the variable speed control rotational movement means to obtain a predetermined ratio of a value of the rotational speed of the lifting rollers driven by the variable speed control rotational movement means to the rotational speed of the lifting rollers driven by the drive train for the group of cans located adjacent the main part, whereby the slivers from the group of cans nearest the main part and the slivers from the cans of the other respective groups are exhausted substantially simultaneously, irrespective of the operating condition of the machine.

3. A machine according to claim 2, wherein the rotational movement means for the drive train adjacent the main part is common to the source for generating rotational movement included in the main part.

4. A machine according to claim 2, wherein said variable speed type driving source comprises an electric variable speed motor and gearing means for transmitting a rotational movement of said motor to the corresponding lifting rollers.

5. A machine according to claim 2, wherein said cans are divided into more than three groups; the rotational movement means for the drive trains for the groups of cans, other than the group adjacent the main part, are variable speed control type, and said means for controlling controls the rotational speed of the drive trains with variable speed sources adjacent each other, so that a desired ratio of rotational speed is obtained between adjacent drive trains.

6. A machine according to claim 2, wherein said rotational movement means for the drive train for the group including the can nearest said main part is constructed as a variable control type capable of obtaining a varied speed of the corresponding lifting rollers, and said machine further comprises means for controlling the rotational movement means for the lifting rollers of the group including the can nearest the main part, in accordance with the amount of silvers remaining in said can nearest the main part.

7. A machine according to claim 6, wherein said means for controlling the rotational movement means for the lifting rollers of the group including the can nearest the main part includes a counter for counting the number of rotations of one of the drafting rollers, and means for controlling the speed of the rotational movement means so that the speed of the rotation of the lifting rollers varies in accordance with the detected value by the counter.

8. A machine for treatment of slivers from a plurality of cans for storing respective slivers, comprising:

a main part comprising a set of rollers through which slivers are drafted, and a main part source for generating rotational movement of said rollers;

a creel device including a frame structure and lifting rollers supported thereby and spaced substantially along a straight line that extends rearwardly from the main part, for taking out slivers from respective cans and directly supplying the slivers to the main part from respective cans that are also arranged substantially along said line;

said cans on said line forming two groups, each of said groups constructed by consecutively located cans along the line;

a separate drive train provided for each of the groups of the cans for obtaining independent rotational movement of the lifting rollers of each of said groups;

separate rotational movement means, connected to each of the drive trains separately, for obtaining independent rotational movement of said drive trains;

at least the rotational movement means for the drive train of the group including the can nearest said main part being constructed as variable speed control device capable of obtaining a varied rotational speed of corresponding lifting rollers, and;

means for controlling the variable rotational movement means for the lifting rollers of the group including the can nearest the main part in accordance with the amount of slivers remaining in a can of the group nearest the main part.

* * * * *